US008388078B2

(12) United States Patent
Kwon et al.

(10) Patent No.: US 8,388,078 B2
(45) Date of Patent: Mar. 5, 2013

(54) REFRIGERATOR WITH A DOOR-IN-DOOR

(75) Inventors: Hong Sik Kwon, Seoul (KR); Yong Hun Chang, Seoul (KR); Jung Yeon Hwang, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 243 days.

(21) Appl. No.: 12/835,775

(22) Filed: Jul. 14, 2010

(65) Prior Publication Data

US 2011/0023528 A1 Feb. 3, 2011

(30) Foreign Application Priority Data

Jul. 28, 2009 (KR) ..... 10-2009-0069026

(51) Int. Cl.
*A47B 96/00* (2006.01)

(52) U.S. Cl. ..... 312/405; 312/292

(58) Field of Classification Search ..... 312/401, 312/402, 404, 405, 324, 326, 292; 62/448, 62/449; 49/61, 62, 63, 67, 125; 16/365, 16/366, 368, 369, 370, 371, 387
See application file for complete search history.

(56) References Cited

U.S. PATENT DOCUMENTS

| | | | | |
|---|---|---|---|---|
| 1,275,511 A | | 8/1918 | Welch | |
| 1,984,977 A | | 12/1934 | Mize | |
| 2,039,130 A | * | 4/1936 | Van Note | 16/278 |
| 2,046,909 A | | 7/1936 | Terry et al. | |
| 2,062,360 A | | 12/1936 | Goulooze | |
| 2,095,811 A | | 10/1937 | Goulooze | |
| 2,112,771 A | | 3/1938 | Goulooze | |
| 2,129,923 A | | 9/1938 | Mortimer | |
| 2,131,680 A | | 9/1938 | Zahodiakin | |
| 2,150,064 A | | 3/1939 | Robert et al. | |
| 2,281,430 A | | 4/1942 | Grant | |
| 2,385,169 A | | 9/1945 | Stone | |
| 2,656,688 A | | 10/1953 | Hinkel | |

(Continued)

FOREIGN PATENT DOCUMENTS

| | | |
|---|---|---|
| EP | 0539558 A1 | 11/1992 |
| JP | 10009757 A | 1/1998 |

(Continued)

OTHER PUBLICATIONS

PCT International Search Report dated Dec. 23, 2010 for Application No. PCT/KR2020/003616, 3 pages.

(Continued)

*Primary Examiner* — James O Hansen
*Assistant Examiner* — Sasha T Varghese
(74) *Attorney, Agent, or Firm* — Fish & Richardson P.C.

(57) ABSTRACT

A refrigerator includes a cabinet configured to define an exterior boundary of the refrigerator with at least one opening therein. The refrigerator also includes a first storage chamber defined by interior walls of the cabinet and configured to store food stuffs and a first door configured to open and close the first storage chamber by rotating about a rotational axis. The refrigerator further includes a second storage chamber that is smaller than the first storage chamber defined at a side of the first door, and that is configured to enable access to food stuffs while the first door remains closed and a second door, located in a predetermined portion of the first door, and configured to open and close the second storage chamber by rotating about the rotational axis.

20 Claims, 10 Drawing Sheets

U.S. PATENT DOCUMENTS

| | | | | | |
|---|---|---|---|---|---|
| 2,783,115 | A | | 2/1957 | York | |
| 2,942,438 | A | | 6/1960 | Schmeling | |
| 2,945,733 | A | * | 7/1960 | Malia | 312/200 |
| 3,086,830 | A | * | 4/1963 | Malia | 312/200 |
| 3,218,111 | A | | 11/1965 | Steiner | |
| 3,287,079 | A | | 11/1966 | Courson | |
| 3,299,573 | A | | 1/1967 | Gustafson | |
| 3,389,424 | A | | 6/1968 | Fellwock | |
| 3,395,423 | A | | 8/1968 | Antonius | |
| 3,510,986 | A | | 5/1970 | Berkowitz | |
| 3,619,853 | A | | 11/1971 | Merrill | |
| 3,643,464 | A | | 2/1972 | Hilliker et al. | |
| 3,766,599 | A | | 10/1973 | Ullman | |
| 3,874,027 | A | | 4/1975 | Parsons | |
| 3,883,204 | A | | 5/1975 | Prada et al. | |
| 4,084,291 | A | | 4/1978 | Crowe | |
| 4,087,140 | A | | 5/1978 | Linstromberg | |
| 4,133,143 | A | | 1/1979 | Campisano | |
| 4,269,039 | A | | 5/1981 | Baker | |
| 4,368,557 | A | | 1/1983 | Inasawa et al. | |
| 4,368,622 | A | | 1/1983 | Brooks | |
| 4,503,583 | A | | 3/1985 | Frohbieter | |
| 4,514,021 | A | * | 4/1985 | Sundermeier et al. | 312/291 |
| 4,586,347 | A | | 5/1986 | McCarty | |
| 5,209,082 | A | | 5/1993 | Ha | |
| 5,411,328 | A | | 5/1995 | You | |
| 5,600,966 | A | | 2/1997 | Valence et al. | |
| 5,966,963 | A | | 10/1999 | Kovalaske | |
| 6,055,823 | A | | 5/2000 | Baker et al. | |
| 6,056,378 | A | | 5/2000 | Semon et al. | |
| 6,547,349 | B2 | | 4/2003 | Sessa et al. | |
| D508,249 | S | | 8/2005 | Seok et al. | |
| D527,398 | S | | 8/2006 | Kim et al. | |
| 7,198,340 | B1 | | 4/2007 | Ertz | |
| 7,254,958 | B2 | | 8/2007 | Kim et al. | |
| 7,784,219 | B2 | | 8/2010 | Yoshikawa et al. | |
| D629,021 | S | | 12/2010 | Cho et al. | |
| 2002/0093276 | A1 | | 7/2002 | Kawakami | |
| 2005/0188506 | A1 | | 9/2005 | Lee et al. | |
| 2009/0139260 | A1 | | 6/2009 | Yoshikawa et al. | |
| 2009/0273264 | A1 | | 11/2009 | Butler | |
| 2010/0170279 | A1 | | 7/2010 | Aoki | |
| 2010/0307186 | A1 | | 12/2010 | Kwon et al. | |
| 2011/0023527 | A1 | | 2/2011 | Kwon et al. | |
| 2011/0023528 | A1 | | 2/2011 | Kwon et al. | |
| 2011/0146323 | A1 | | 6/2011 | Choi | |
| 2011/0232317 | A1 | | 9/2011 | Flores | |
| 2011/0232323 | A1 | | 9/2011 | Morris | |

FOREIGN PATENT DOCUMENTS

| | | | |
|---|---|---|---|
| KR | 20-19900008203 | Y1 | 9/1990 |
| KR | 10-19970007503 | B1 | 5/1997 |
| KR | 1999039593 | A | 6/1999 |
| KR | 1999042339 | A | 6/1999 |
| KR | 10-0376167 | B | 3/2003 |
| KR | 2003083813 | A | 11/2003 |
| KR | 887575 | B1 | 3/2009 |
| KR | 10-20090077564 | A | 7/2009 |

OTHER PUBLICATIONS

U.S. Office Action dated Apr. 16, 2012 for U.S. Appl. No. 12/792,601, 15 pages.

* cited by examiner

REFRIGERATOR WITH A DOOR-IN-DOOR

CROSS REFERENCE TO RELATED APPLICATION

This application claims the benefit of priority to Korean Application No. 10-2009-0069026, filed on Jul. 28, 2009, which is herein expressly incorporated by reference in its entirely.

FIELD

The present disclosure relates to a refrigerator.

BACKGROUND

Refrigerators have at least one storage chamber for storing food stuffs and the storage chambers are selectively closed by doors. In general, such a storage chamber may be classified into a freezer chamber and a refrigerator chamber, and refrigerators may be classified into several types based on freezer/refrigerator chamber arrangement, door appearance or door closing structure.

Typically, a predetermined space for preserving food stuffs is defined by a door. For example, a door basket having a predetermined space is provided in the door to preserve food stuffs contained in relatively tall containers, for example, bottles. A user opens the door to put or take the food stuffs into or out of the door basket defined in the door. That is, the door basket is accessible from an inner side of the door. Another type of food storage space provided in the door is a storage chamber commonly called as a home bar. Such the storage chamber, namely, a home bar, is provided in the door and it is accessible from an outer side of the door via an auxiliary door additionally provided in the door. That is, without opening the door, the user opens the auxiliary door to put or take in or out food stuffs provided in the door storage chamber. A structure of the refrigerator has been diversified and demands for improving user convenience of the refrigerator have been increased.

SUMMARY

In one aspect, a refrigerator includes a cabinet configured to define an exterior boundary of the refrigerator with at least one opening therein. The refrigerator also includes a first storage chamber defined by interior walls of the cabinet and configured to store food stuffs and a first door configured to open and close the first storage chamber by rotating about a rotational axis. The refrigerator further includes a second storage chamber that is smaller than the first storage chamber defined at a side of the first door, and that is configured to enable access to food stuffs while the first door remains closed and a second door, located in a predetermined portion of the first door, configured to open and close the second storage chamber by rotating the rotational axis, wherein a rotation direction of the second door is identical to the rotation direction of the first door. In addition, the refrigerator includes a rotational shaft coupled to an upper surface of second door to establish the rotational axis, a first connection member configured to connect the rotational shaft to the cabinet; and a second connection member connected to the rotational shaft to the first door.

Implementations may include one or more of the following features. For example, the refrigerator further includes a recess means positioned on an upper surface of the first door. The refrigerator further includes a recess means positioned on the upper surface of the second door. The refrigerator further includes a projection means positioned in front of the recess of the second door and configured to be projected upward. The rotational shaft is positioned on the recess means of the second door. The first and second connecting members are configured to be a curved shape horizontally. The first and second connecting members are configured to be a curved shape horizontally toward an edge of the refrigerator.

In some examples, the first and second connecting members positioned on the second door are configured to be a curved shape horizontally. The first member is configured to be a curved shape vertically. An appearance of the second door is corresponding to an appearance of the first door. A width of the second door is substantially identical to a width of the first door.

In another aspect, a refrigerator includes a cabinet configured to define an exterior boundary of the refrigerator with at least one opening therein. The refrigerator also includes a first storage chamber defined by interior walls of the cabinet and configured to store food stuffs and a first door configured to open and close the first storage chamber by rotating about a first rotational axis. The refrigerator further includes a second storage chamber that is smaller than the first storage chamber defined at a side of the first door, and that is configured to enable access to food stuffs while the first door remains closed and a second door, located in a predetermined portion of the first door, configured to open and close the second storage chamber by rotating a second rotational axis, wherein a rotation direction of the second door is identical to the rotation direction of the first door. In addition, the refrigerator includes a first rotational shaft coupled to an upper surface of first door to establish the first rotational axis, a second rotational shaft coupled to an upper surface of first door to establish the second rotational axis, a first connection member configured to connect the rotational shaft to the cabinet and a second connection member connected to the rotational shaft and the second rotational shaft.

Implementations may include one or more of the following features. For example, the refrigerator further includes a recess means positioned on the upper surface of the first door. The first rotation shaft is positioned on the recess means of the first door. The refrigerator further includes a recess means positioned on the upper surface of the second door. The second rotation shaft is positioned on the recess means of the second door.

In some examples, the refrigerator further includes a projection means positioned in front of the recess of the second door and configured to be projected upward. The second connecting member is configured to be a curved shape horizontally. The first connecting member is configured to be a curved shape horizontally toward an edge of the refrigerator. The second connecting member positioned on the second door is configured to be a curved shape horizontally.

It is to be understood that both the foregoing general description and the following detailed description are exemplary and explanatory.

DETAILED DESCRIPTION

Reference will now be made in detail to implementations, examples of which are illustrated in the accompanying drawings. Wherever possible, the same reference numbers will be used throughout the drawings to refer to the same or like parts.

As follows, a refrigerator according to an exemplary implementations of the present disclosure will be described in reference to the accompanying drawings.

Figure 1:
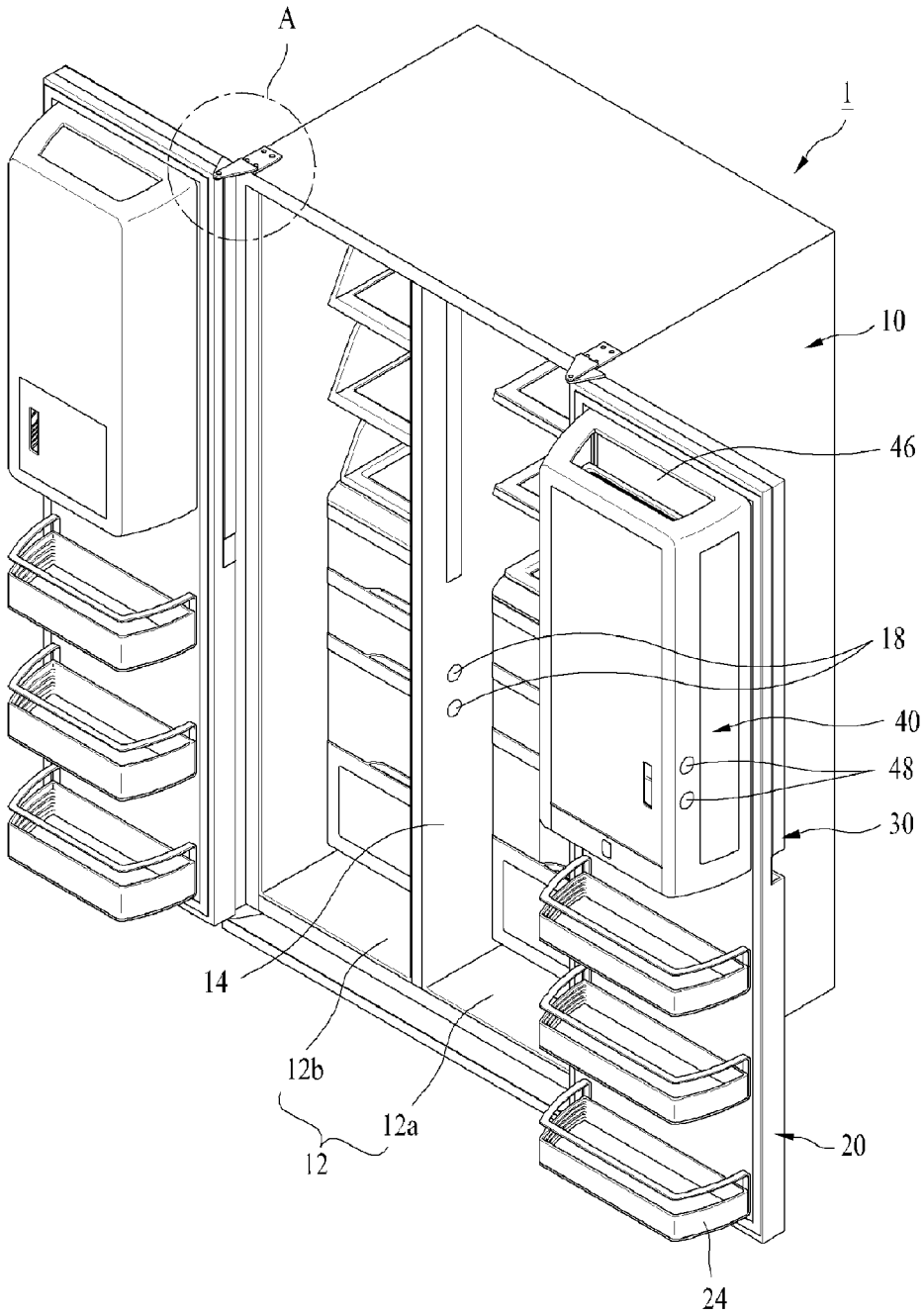
FIG. 1 is a view illustrating a refrigerator in a state of a first storage chamber being opened.

In reference to FIG. 1, an overall structure of the refrigerator will be described. A side by side type refrigerator is embodied to describe the present disclosure as an example.

A first storage chamber 12 is defined in a cabinet 10 of the refrigerator 1 to preserve food stuffs therein. The first storage chamber 12 may include a freezer chamber 12*b* and a refrigerator chamber 12*a*. According to a side-by-side type refrigerator, the freezer chamber 12*b* and the refrigerator chamber 12*a* are arranged horizontally, that is side by side.

A first door 20 is defined in a front surface of the cabinet 10 to selectively open and close the first storage chamber 12. A second storage chamber 40 is defined in the first door 20 to preserve food stuffs therein, and the second chamber 40 is selectively opened and closed by a second door 30.

Each of the above configurations will be described in detail as follows.

The first storage chamber 12 defined in the cabinet 10 of the refrigerator 1 is partitioned into the freezer chamber 12*b* and the refrigerator chamber 12*a* by a partition wall 14. Here, at least one shelf and drawer may be installed in the first storage chamber 12.

The second storage chamber 40 is defined in the first door 20, and it has a predetermined space to preserve food stuffs. The second storage chamber 40 is configured to surround the predetermined defined space. That is, the second storage chamber 40 has the predetermined space positioned inside of the door 20 and it is accessible from an outside of the first door 20. For example, the second storage chamber 40 is accessible through an inside of the first door 20, and the second storage chamber 40 is accessible via a second door 30 coupled to the outer surface of the first door 20. Another type of storage space, for example, a door basket 25 may be defined in the inside of the first door 20, different from the second storage chamber 40. The door basket 25 is accessible from the inner side of the first door 20. In this implementation, the door basket 25 is not accessible via the second door 30 and the door basket is accessible after the first door 20 is opened.

In some examples, the second storage chamber 40 is typically a predetermined surrounded space and it may include a structure capable of receiving cold air to the second storage chamber 40. The second storage chamber 40 may include a first communication part 46 in communication with the first storage chamber 12 such that cold air of the first storage chamber 12 is supplied to the second storage chamber 40. To supply the cold air to the second storage chamber 40, a fan may be positioned around the first communication part 40. In this implementation, the first communication part 46 may block supplying the cold air to the second storage chamber 40 when a temperature in the second storage chamber 40 is determined to be cold enough to preserve the food stuffs. A second communication part 48, in direct communication with an end of a cold air duct 18 positioned on the partition wall 14 of the cabinet 10 may be defined in the second storage chamber 40. The second communicate part 48 defines at least one passage that the cold air passes through.

Figure 2:
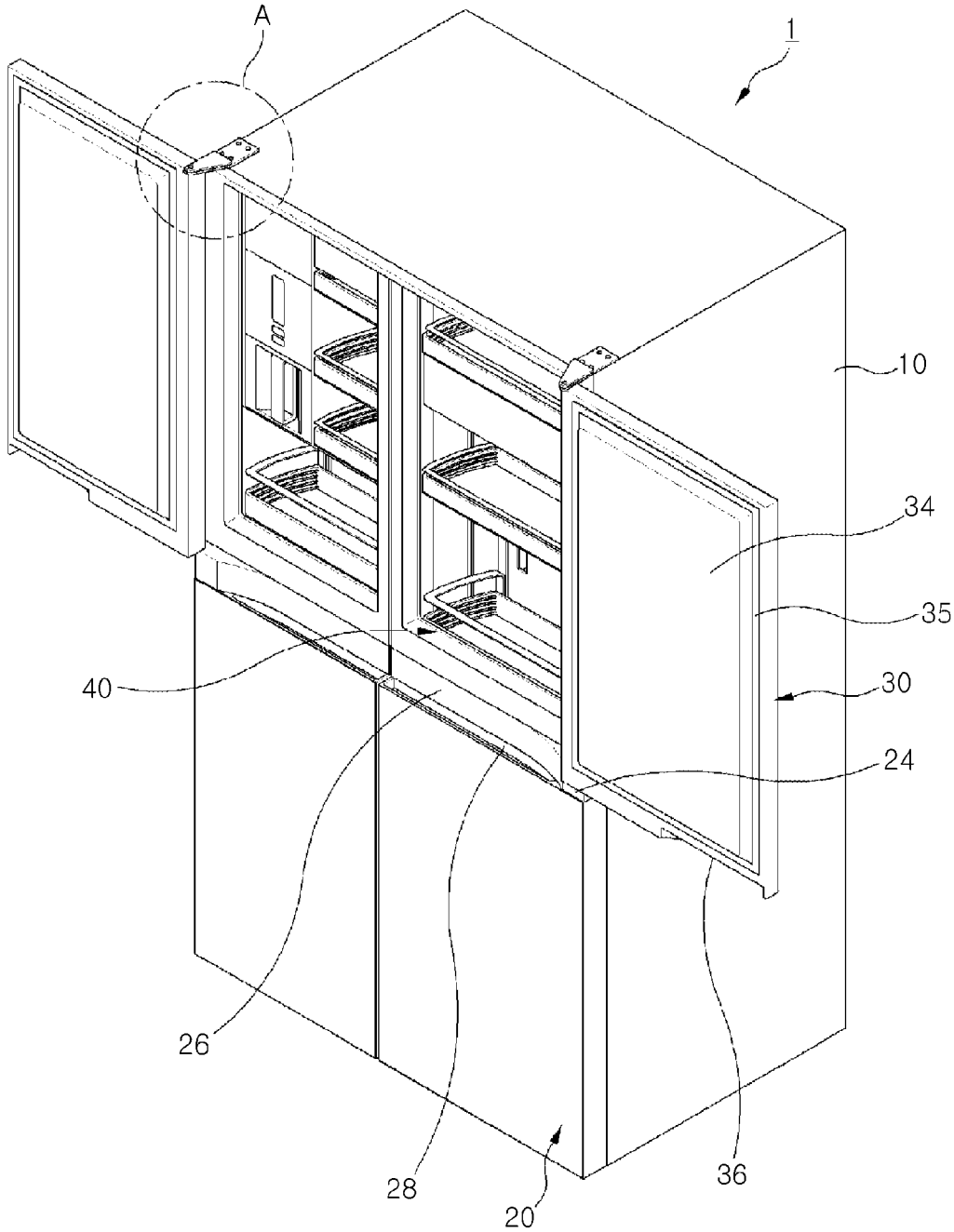
FIG. 2 is a view illustrating the refrigerator in a state of a second storage chamber being opened.

In reference to FIGS. 2 and 3, the first door and the second door will be described in detail.

The first door 20 includes a securing part 21 recessed toward the cabinet 10 and the second door 30 may be secured in the securing part 21. A step 29 stepped toward the cabinet 10 is defined in a predetermined portion of the first door 20, for example, approximately a middle portion of the first door shown in FIGS. 2 and 3.

The appearance of the second door 30 may be corresponding to the appearance of the first door 20, although it may be otherwise configured. In some examples, the width of the second door 30 may be substantially identical to the width of the first door 20. The height of the second door 30 may be changeable. And the thickness of the second door 30 may be identical to the thickness of the securing part 21. Although the height of the second door 30 defined in a predetermined portion of the first door 20 may be changed, a user recognizes the second door 30 as the first door 20 itself or a part of the first door 20, such that beauty of the refrigerator 1 may not be damaged.

In the implementation, a first recess 26 which is recessed inward, may be located in a predetermined portion of the first door 20, for example, between a lower surface of the second door 30 and a coupling part 24 that is rotatably coupled to the first door. A second recess 28 recessed downward from the first recess 26 may be defined in the first door 20. A third recess 36 recessed upward from a lower surface of the second door 30, which is adjacent to the first recess 26, may be located in the second door 30. This configuration allows the second and third recesses 28 and 36 to function as handles for the first and second doors, respectively, and thus auxiliary handles do not have to be provided in the first and second doors 20 and 30.

A projection part 34, projected upward, is defined in the second door 30 and a gasket 35 may be coupled to a circumstance of the projection part 34 for sealing the second door 30.

In reference to FIG. 3, a coupling and rotation structure of the first door and the second door will be described. As an example, the second door 30 is secured in the securing part 21 of the first door 20.

The first door 20 selectively opens and closes the first storage chamber 12 and the second door 30 selectively opens and closes the second storage chamber defined in the first door 20. In this implementation, a rotational direction of the first door 20 is identical to that of the second door 30. For example, the first door 20 is rotatable with respect to a vertical shaft in the conventional refrigerator and the second door 30 is also rotatable with respect to the vertical shaft.

If the rotational direction of the first door 20 is identical to that of the second door 30, a rotational radius of the conventional refrigerator 1 may be determined based on the first door 20 for opening and closing the first storage chamber. As a result, the user should arrange the refrigerator without any obstacles placed in the rotational radius of the first door 20. Also, if the rotational direction of the second door 30 is identical to that of the first door, it may be possible to increase the size of the second storage chamber defined in the first door 20. Also, if the rotational directions of the first and second doors 20 and 30 are identical, the sealing structure between the first and second doors 20 and 30 may be applicable to the sealing structure between the cabinet 10 and the first door 20.

In this implementation, the rotational shaft of the first door 20 is parallel to the rotational shaft of the second door 30. The rotational shafts of the first and second doors 20 and 30 are located on the same line. If then, only a single rotational shaft may be used to simplify an assembly structure of the refrigerator 1. Alternatively, in this implementation, the rotational shafts of the first and second doors 20 and 30 may be located at opposite side. For example, the first rotational shaft for the first door 20 is located at a right side of the refrigerator while the second rotational shaft for the second door 30 is located at a left side in case that the refrigerator 1 is not the side by side type. Therefore, the user can open the first door 20 in a first rotation direction in which the first door 20 rotates with respect to the rotational shaft in the right side. Also, the user can open the second door 30 in a second rotation direction which is opposite of the first rotation direction in which the second door 30 rotates with respect to the rotational shaft located in the left side.

Figure 4:
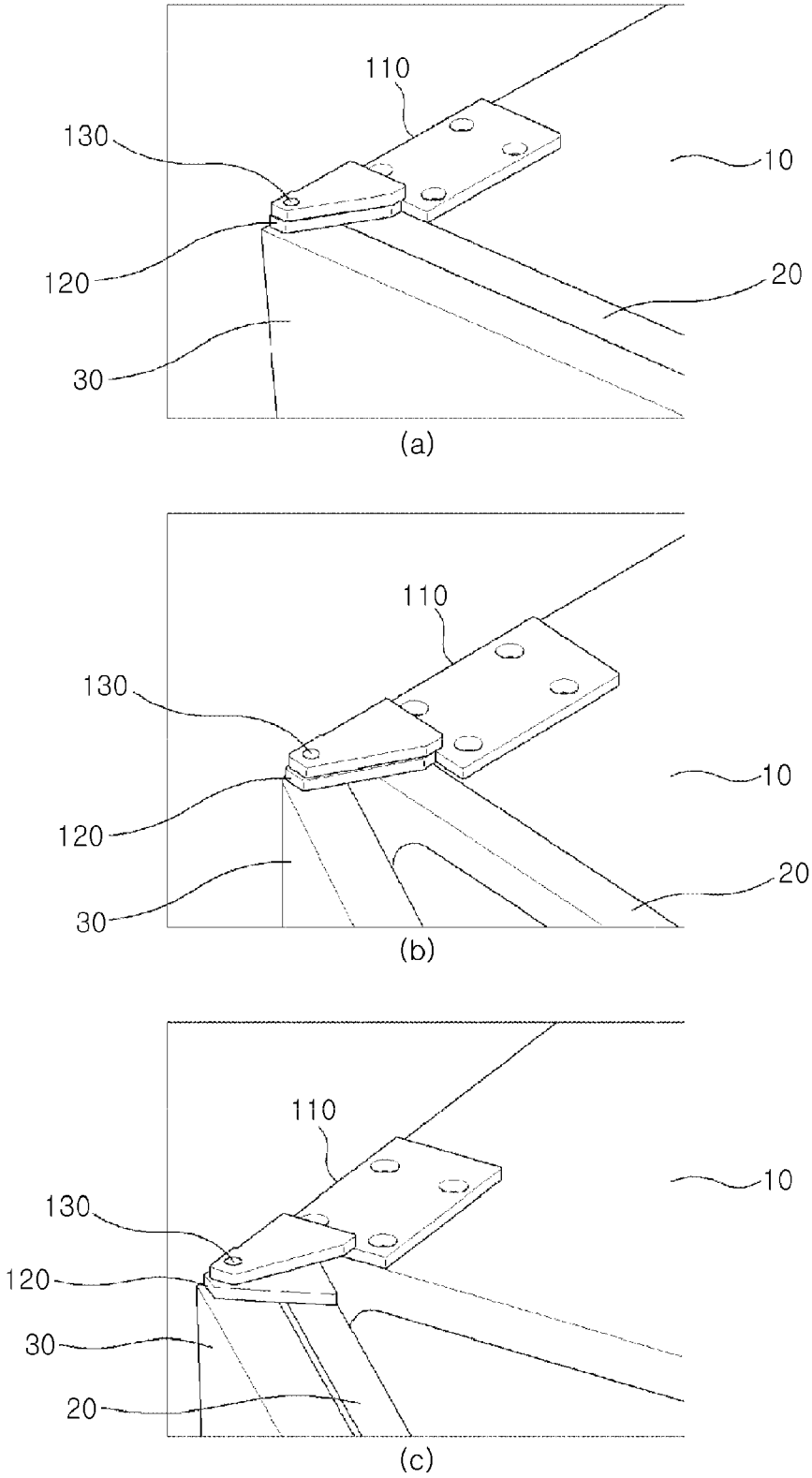
FIG. 4 is a diagram illustrating a first door and a second door of the refrigerator, in a state of being opened.

Referring to FIG. 4, an upper structure to selectively open the first door 20 and the second door 30 includes a first connection member 110, a second connection member 120 and a rotational shaft 130.

An end of a first connection member 110 is coupled to an upper surface of the cabinet 10 and the other end of the connection member 110 is connected to an upper surface of the second door 30 through the medium of the rotational shaft 130. An end of a second connection member 120 is coupled to an upper surface of the first door 20 and the other end of the second connection member 120 is connected to the upper surface of the second door 30 through the medium of the same upper rotational shaft 130. The second connection member 120 may be located below the first connection member 110. As a result, the upper rotational shaft 130 is employed as common upper rotational shaft for the first and second doors 20 and 30.

Figure 3:
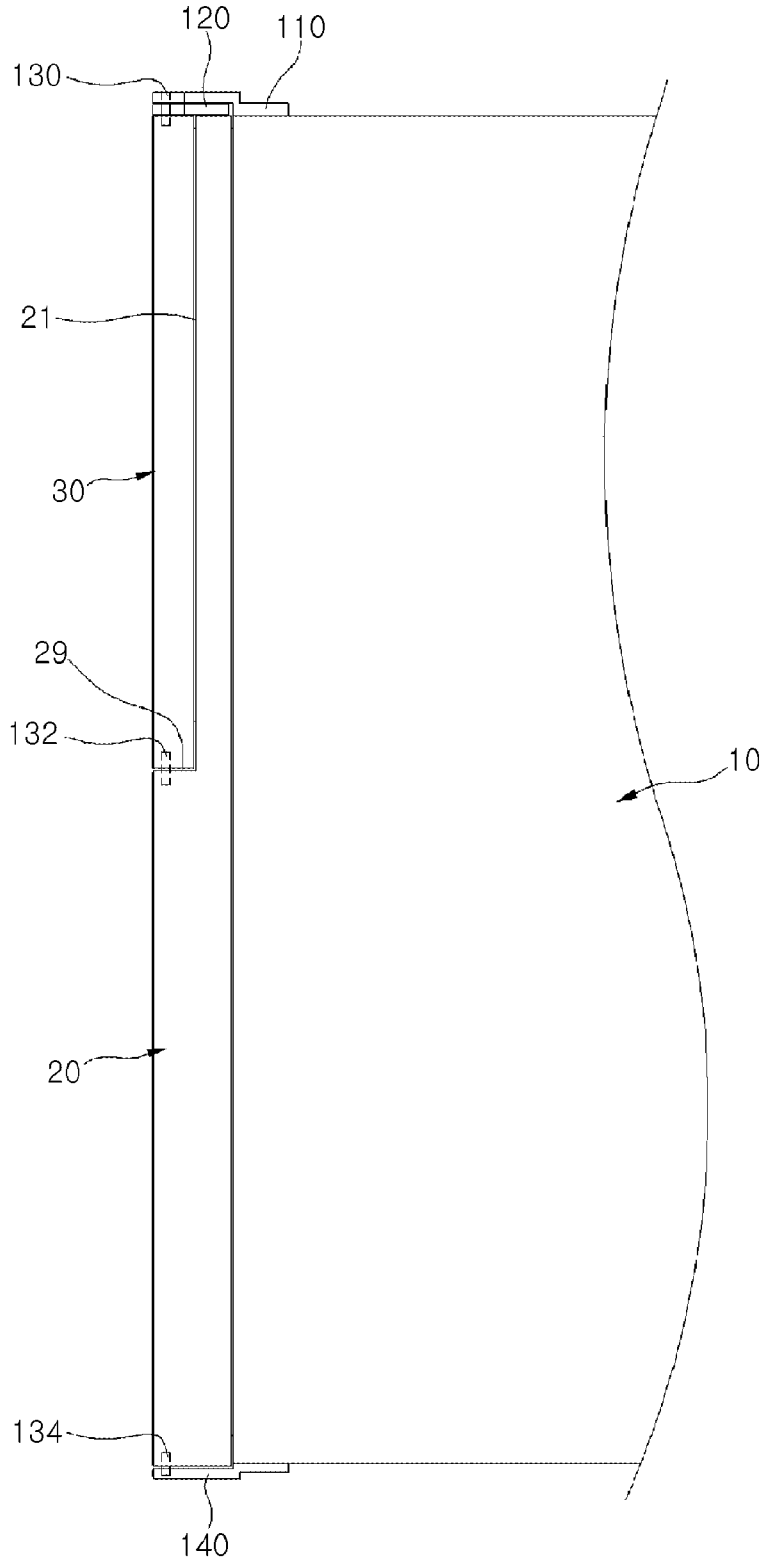
FIG. 3 is a longitudinal-sectional view of FIG. 1.

Referring to FIG. 3, a rotational shaft 132 for a lower portion of the second door 30 is defined in a lower surface of the second door 30 and the lower rotational shaft 132 is connected to the coupling part 24 (see, FIG. 2) defined in the securing part 21 of the first door 20. A rotational shaft 134 for a lower portion of the first door 20 is defined in a lower surface of the first door 20 and the lower first door rotational shaft 134 is connected to a lower surface of the cabinet 10 by a third connection member 140, as shown in FIG. 4.

FIG. 4*a* shows a configuration of the upper structure in a closed state of the first and second doors 20 and 30.

FIG. 4*b* shows a configuration of the upper structure in a open state of the second door 30. The user can open the second door 30 to approach to the second storage chamber 40 defined in the first door 20. if the user pulls only the second door 30 in a forward direction by using the handle 36 as shown in FIG. 1, the second door 30 is rotated with respect to the common upper rotational shaft 130 and the lower rotational shaft 132 (see, FIG. 3*while* the first door 20 not opened, and the second storage chamber 40 is thus opened.

FIG. 4C shows a configuration of the upper structure in an open state of the first door 20.

The user can open the first door 20 to approach to the first storage chamber 12. If the user pulls the first door 20 forward by using a handle as shown in FIG. 1, the first and second doors are rotated together with respect to the common upper rotational shaft 130 and the lower first door rotational shaft 134 (see, FIG. 3) and then the first storage chamber 12 is opened. In this implementation, the second connection member 120 is rotated such that the first and the second doors 20 and 30 can rotate together.

Figure 5:
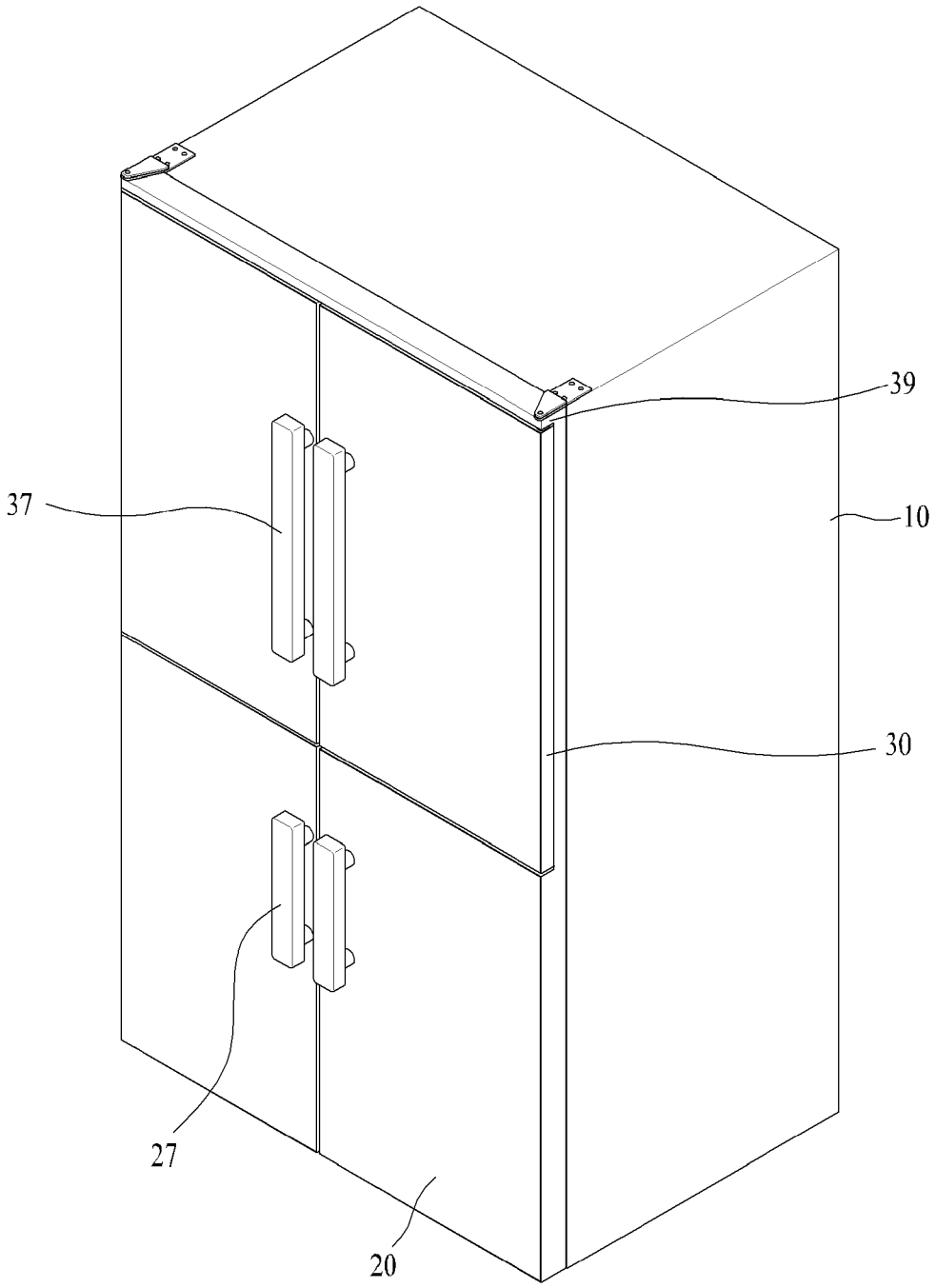
FIG. 5 is a view illustrating a refrigerator.

As an example, FIG. 5 shows a handle 27 for opening and closing the first door 20 and a handle 37 for opening and closing the second door positioned on outer surfaces of the first and second doors 20 and 30, respectively. As mentioned in the description, a recess used as a handle may be defined in the first and second doors, respectively.

Figure 6:
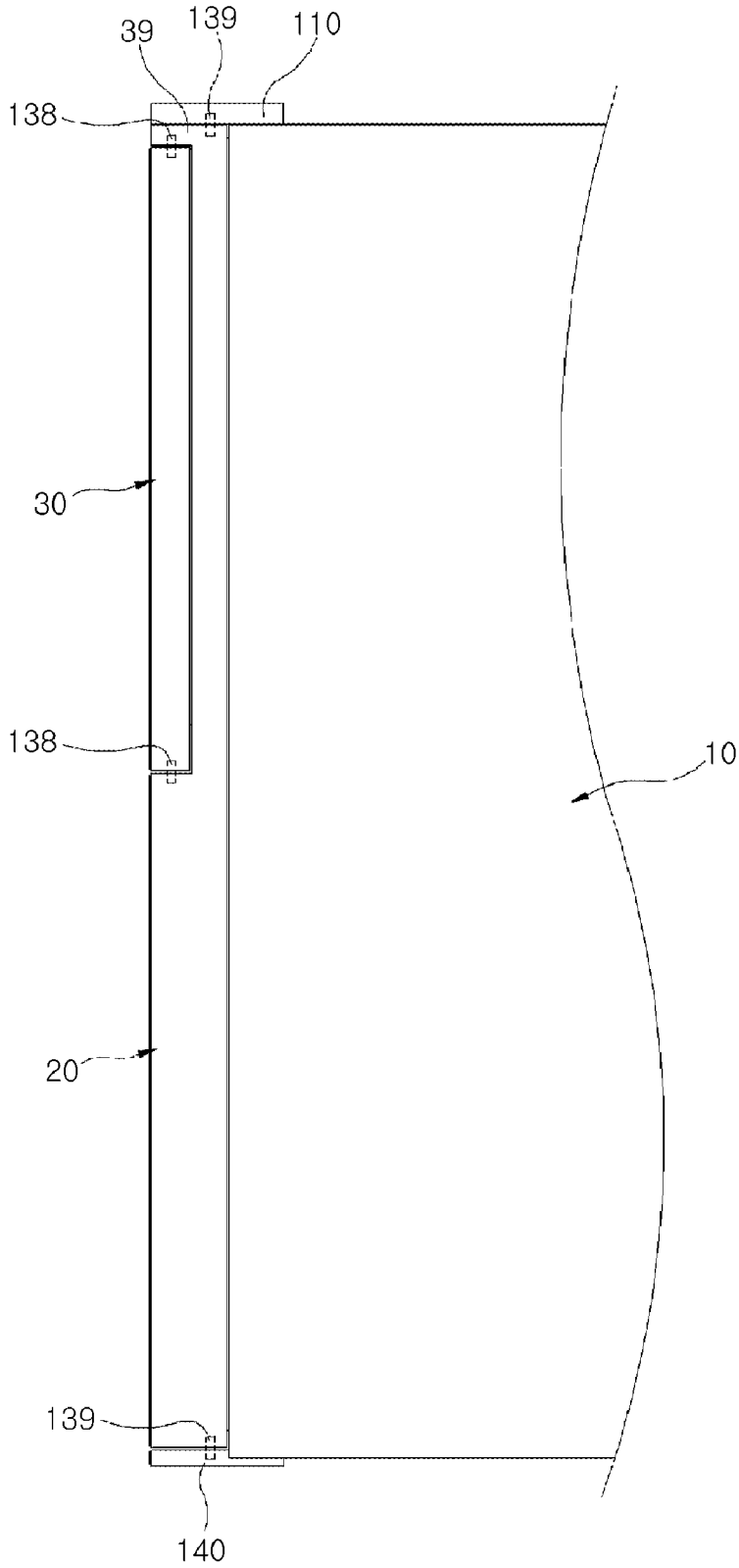
FIG. 6 is a longitudinal-sectional view.

Referring to FIG. 6, a projection part 39 is defined in an upper portion of the first door 20 to rotatably couple the upper surface of the second door 30 to a lower surface of the projection part 39. As a result, the upper surface of the second door 20 is located under the projection part 39 of the first door 20.

A pair of rotational shafts for the first door 139 may be provided in the first door 20 and a pair of rotational shafts for the second door 138 may be provided in the second door 30. The first door rotational shaft 139 and the second door rotational shaft 138 are parallel but offset.

In some implementations, the first door rotational shaft 139 and the second door rotational shaft 138 may be located at the same shaft line. In this case, an upper rotational shaft of the first door 139 and an upper rotational shaft of the second door 138 may be on the same rotational shaft line.

In case of a door structure in FIG. 6, a hinge structure may be installed in inner surfaces of the first and second doors 20 and 30, instead of the rotational shaft 138 of the second door 30.

Figure 7:
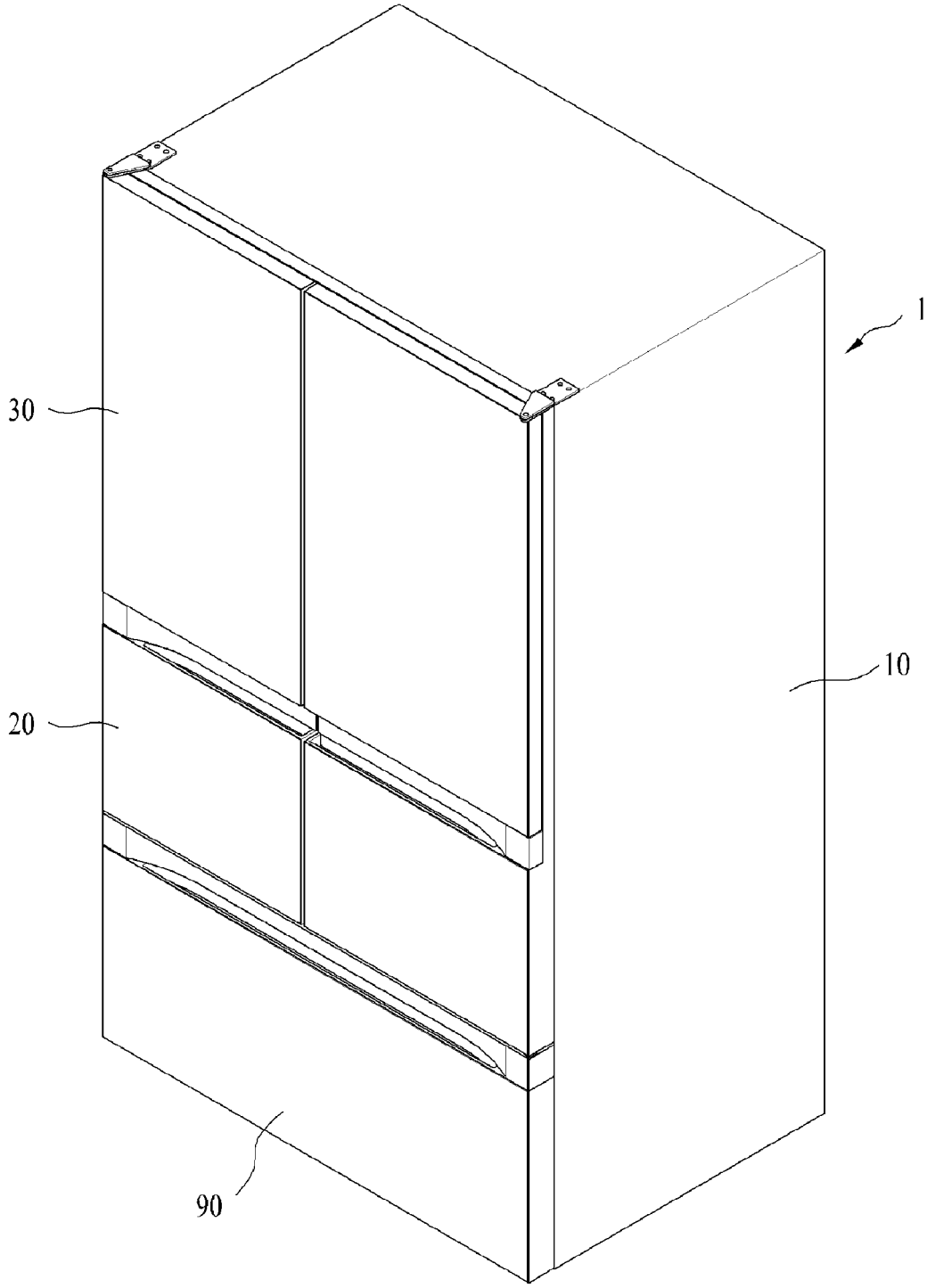
FIG. 7 is a view illustrating a refrigerator.

Referring to FIG. 7, the present disclosure may be applicable to a refrigerator having the refrigerator chamber arranged in the upper portion of the cabinet and the freezer chamber defined in the lower portion of the cabinet. In this implementation, the first door 20 selectively opens and closes the refrigerator chamber and the second door selectively opens and closes a portion of the refrigerator chamber, for example, a home bar. In this implementation, a sliding door 90 is located below the first door 20 to selectively open and close the freezer chamber.

Further, the appearance of the first door is corresponding to that of the second door. For example, the width of the first door is identical to the width of the second door and the length of the second door is smaller than the length of the first door. Also, the present disclosure may be applicable to a case in that both of the width and the height of the second door may be smaller than those of the first door.

Figure 8A:
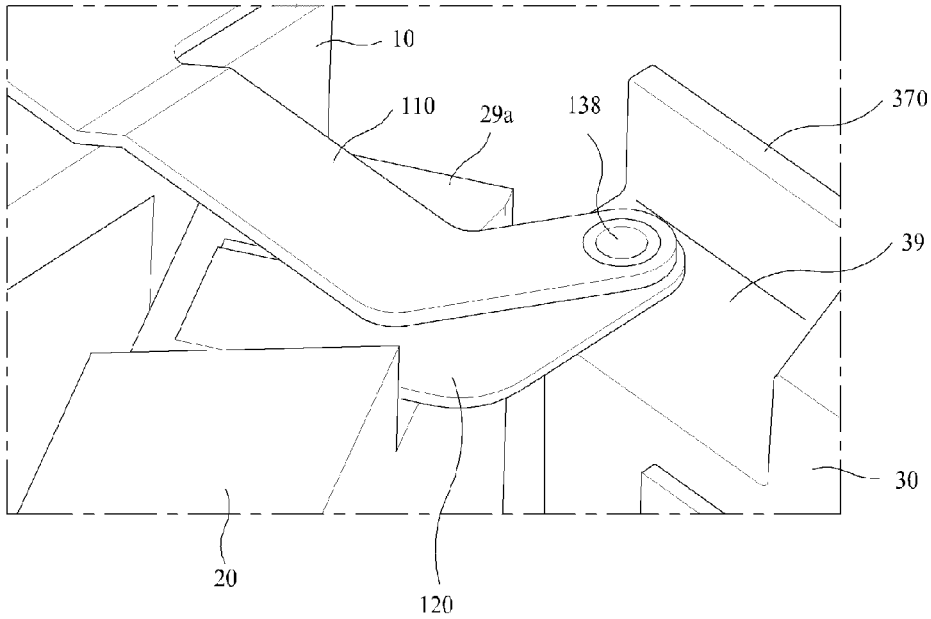
FIGS. 8*a* and 8*b* are views illustrating a door structure.
Figure 8B:
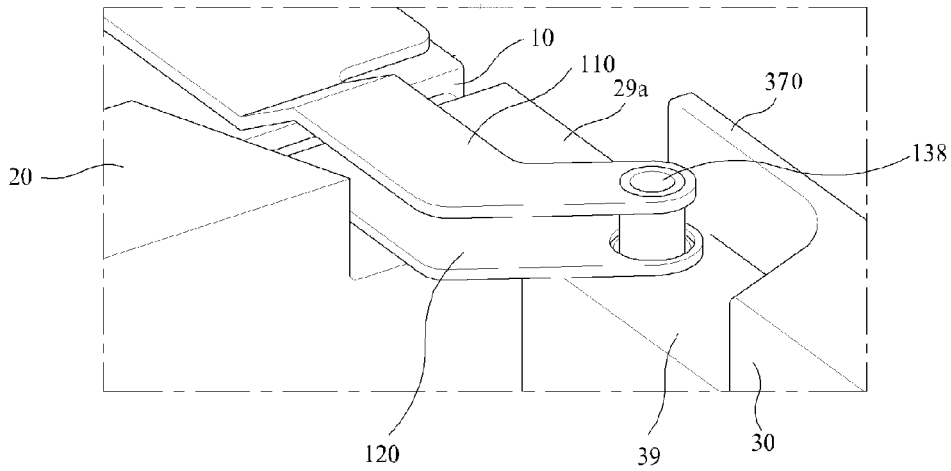

Referring to FIGS. 8*a* and 8*b*, an implementation will be described as follows.

This implementation is basically identical to the previous implementation, except the structure of the first and second connection members that connect the cabinet 10 to the first door 20 and the first door to the second door 30, respectively.

As shown in FIG. 4, the end of the second connection member 120 is projectedly extending upward and the second connection member 120 is located under the extending portion, to locate the second connection member 120 under the first connection member 110. That is, the first connection member 110 has the step.

However, according to this implementation, as shown FIGS. 8*a* and 8*b*, recesses 29*a* and 39 are position at the upper surfaces of the first and second doors 20 and 30, respectively, instead of projecting the end of the first connection member 110, and then the second connection member 120 is located in the recesses 29*a* and 39. Here, the second connection member 120 and the upper rotational shaft 138 may be exposed to the front of the refrigerator. Because of that, the overall appearance of the refrigerator may deteriorate. To prevent the deterioration of the overall appearance, a projection part 370 may be positioned at a predetermined portion of the second door 30 that is in front of the recesses 29*a* and 39.

The shapes of the first connection member 110 and the second connection member 120 are different from the previous implementation which is shown in FIG. 4. The first member 110 and the second member 120 have a curved shape vertically. For example, a middle portion of the connection members are protruded as shown in FIG. 8. Also, the first connection member 110 and the second connection member 120 have a curved shape horizontally. For example, from an edge of the first door 20 to the second door 30, the first connection member 110 and the second connection member 120 have a horizontally round shape toward to the left edge of the refrigerator.

Figure 9:
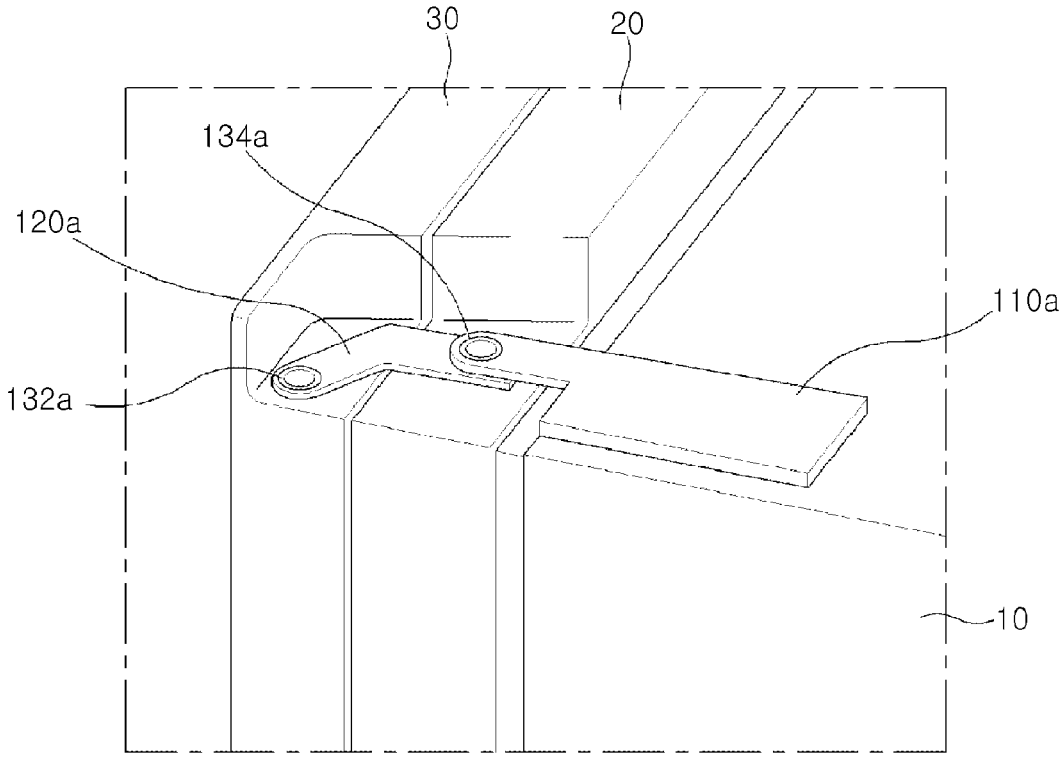
FIG. 9 is a perspective view illustrating a door structure.
Figure 10:
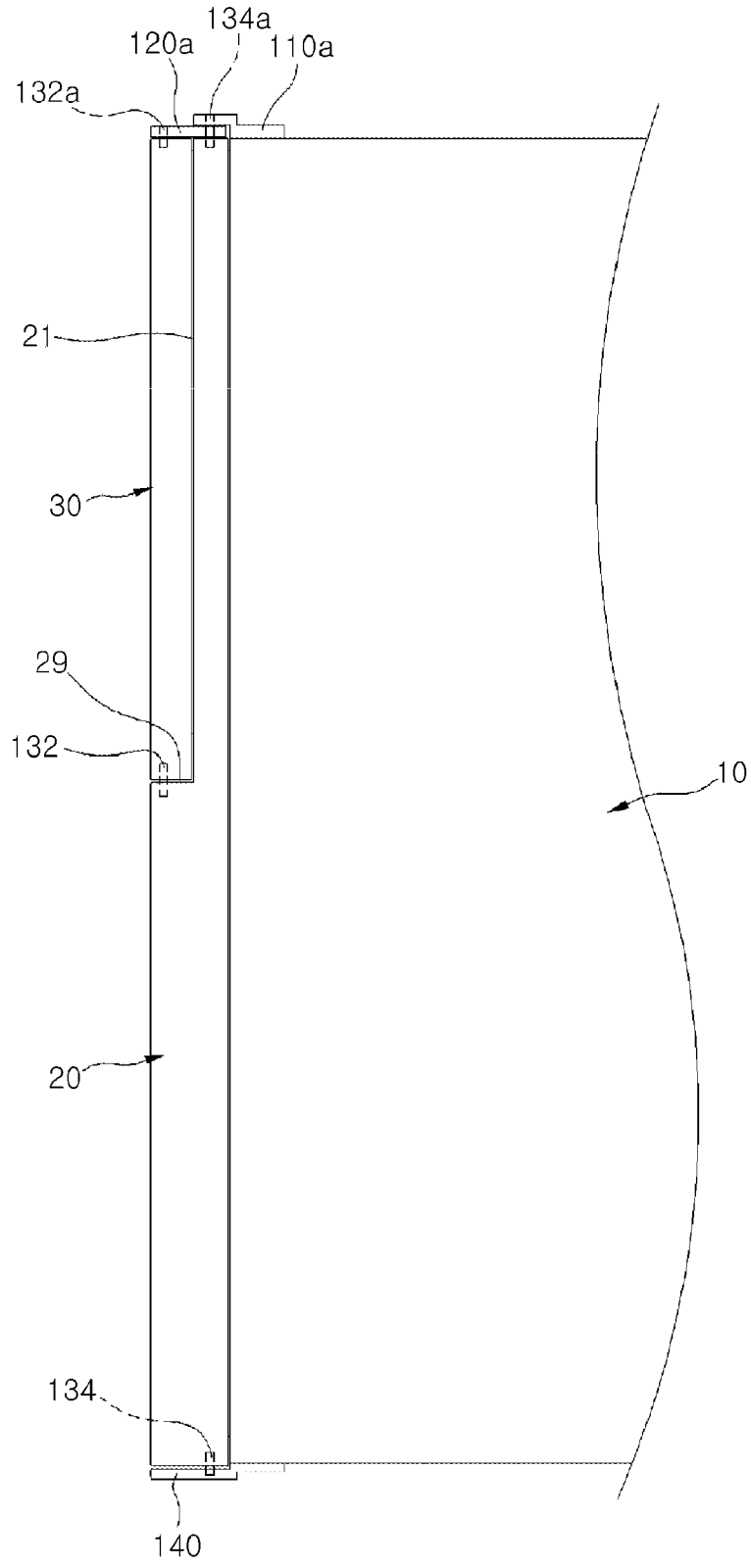
FIG. 10 is a side-sectional view of FIG. 9.

Referring to FIGS. 9 and 10, this implementation shows that a rotational axis to the lower shaft 134 from the upper shaft 134*a* of the first door 20 is parallel to a rotational axis to the lower shaft 132 from the upper shaft 132*a* of the second door 30. That is, the rotational axis between 134 and 134*a* of the first door 20 is located apart a predetermined distance from the rotational axis between 132 and 132*a* of the second door 30. Here, each positions of the rotational shafts 134 and 134*a* and 132 and 132*a* of the first and second doors 20 and 30 may be determined appropriately. For example, the first door rotational shafts 134 and 134*a* are coupled to the first door 20 vertically. Then, a first connection member 110*a* is positioned between the cabinet 10 and the upper first door rotational shaft 134*a*, and a third connection member 140 is connected between the cabinet 10 and the lower first door rotational shaft 134, such that the first door 20 may be rotatable with respect to the first door rotational shaft 134 and 134*a*.

The second door rotational shafts 132 and 132*a* are coupled to the second door 30 vertically. Then, a second connection member 120*a* is positioned between the first door 20 and the upper second door rotational shaft 132*a* and the lower second door rotational shaft 132 is positioned between a lower portion of the second door 30 and the step 29 of the first door 20 such that the second door 30 may be rotatable with respect to the second door rotational shaft 132 and 132*a*. This implementation presents that an end of the second connection member 120*a* is securely located in the upper first door rotational shaft 134*a* as shown in FIG. 9 and the present invention is not limited thereto. In consideration of the rotational radius of the first and second doors 20 and 30, the end of the second connection member is secured to another different portion of the first door 20.

This implementation is advantageous to determine the interval of the cabinet 10 and the first door 20 and the interval of the first door 20 and the second door 30, because the rotational shafts 134 and 134*a* of the first door 20 and the rotational shafts 132 and 132*a* of the second door 30 are not located on the same shaft line.

In the meanwhile, like the above implementation shown in FIGS. 8*a* and 8*b*, it is possible to include the recesses (29*a* and 39, see FIGS. 8*a* and 8*b*) defined in the upper surfaces of the first and second doors 20 and 30, respectively, to locate the second connection member 120*a* in the recesses.

What is claimed is:

1. A refrigerator comprising:

a cabinet;

a first storage chamber defined within the cabinet;

a first door configured to open and close at least a portion of the first storage chamber by rotating;

a second storage chamber that is smaller than the first storage chamber, that is defined at a side of the first door, and that is configured to move with the first door when the first door rotates between opened and closed positions;

a second door configured to open and close the second storage chamber by rotating in a same direction as the first door, that enables access to the second storage chamber when the first door is oriented in a closed position, and that includes a recessed portion at an uppermost edge of the second door at a side of the second door that faces the first door when the second door is oriented in a closed position, an uppermost edge of the second door being flush with an uppermost edge of the first door when the second door is oriented in a closed position and the recessed portion of the second door being a cutout region in an uppermost corner of the second door; and a hinge that attaches to an upper portion of the second door, that enables rotation of the second door, and that is located in the recessed portion at the uppermost edge of the second door such that the hinge is hidden by a front side of the second door when the second door is oriented in a closed position, the front side of the second door being a side of the second door that is furthest from the first door when the second door is oriented in a closed position and a main body of the hinge being accommodated in the cutout region in the uppermost corner of the second door.

2. The refrigerator of claim 1, wherein the first door includes a recessed portion at an uppermost edge of the first door at a position adjacent to the recessed portion of the second door when the second door is oriented in a closed position, the recessed portion of the first door being a cutout region in an uppermost corner of the first door.

3. The refrigerator of claim 2, wherein the hinge attaches to the first door at the recessed portion of the first door.

4. The refrigerator of claim 3, further comprising:

a projection positioned in front of the recessed portion of the second door and configured to project upward, the projection covering the hinge when viewed from the front side of the second door.

5. The refrigerator of claim 3, wherein the hinge comprises a rotational shaft positioned on the recessed portion of the second door and a connection member that connects the rotational shaft to the first door.

6. The refrigerator of claim 1, wherein the hinge has a curved shape.

7. The refrigerator of claim 6, wherein the hinge comprises a rotational shaft positioned on the recessed portion of the second door and a connection member that connects the rotational shaft to the first door, wherein the connection member has a curved shape.

8. The refrigerator of claim 1, wherein the hinge is a second hinge, and the refrigerator further comprises:

a first hinge that attaches to a rotational shaft of the first door, that attaches to the cabinet, and that enables rotation of the first door.

9. The refrigerator of claim 8:

wherein the first door includes a recessed portion at an uppermost edge of the first door at a position adjacent to the recessed portion of the second door when the second door is oriented in a closed position, the recessed portion of the first door being a cutout region in an uppermost corner of the first door;

wherein the second hinge attaches to the first door at the recessed portion of the first door;

wherein the first hinge attaches to the rotational shaft of the first door at the recessed portion of the first door and a main body of the first hinge is accommodated in the cutout region in the uppermost corner of the first door; and wherein the first hinge is hidden by the front side of the second door when the second door is oriented in a closed position.

10. The refrigerator of claim 9:

wherein the second hinge comprises a second rotational shaft positioned on the recessed portion of the second door and a second connection member that connects the second rotational shaft to the first door at the recessed portion of the first door; and wherein the first hinge comprises a first rotational shaft positioned on the recessed portion of the first door and a first connection member that connects the first rotational shaft to the cabinet.

11. The refrigerator of claim 1, wherein the second door aligns with three edges of the first door when the second door is oriented in a closed position.

12. The refrigerator of claim 1, wherein the second door spans an entire width of the first door.

13. The refrigerator of claim 12, wherein a width of the second door is substantially identical to a width of the first door.

14. A refrigerator comprising:

a cabinet;

a first storage chamber defined within the cabinet;

a first door configured to open and close at least a portion of the first storage chamber by rotating;

a second storage chamber that is smaller than the first storage chamber, that is defined at a side of the first door, and that is configured to move with the first door when the first door rotates between opened and closed positions;

a second door that is configured to open and close the second storage chamber by rotating in a same direction as the first door and that enables access to the second storage chamber when the first door is oriented in a closed position;

a first rotational shaft that is coupled to an upper surface of the first door and that establishes a first rotational axis for the first door, the upper surface of the first door being a top horizontal face of the first door that is coplanar with a ceiling of the cabinet;

a second rotational shaft that is coupled to an upper surface of the second door and that establishes a second rotational axis for the second door, the upper surface of the second door being a top horizontal face of the second door that is coplanar with the ceiling of the cabinet;

a first connection member configured to connect the first rotational shaft to the cabinet; and a second connection member configured to connect the second rotational shaft to the upper surface of the first door.

15. The refrigerator of claim 14, wherein the first door includes a recessed portion at the upper surface of the first door, and the recessed portion of the first door is a cutout region in an uppermost corner of the first door.

16. The refrigerator of claim 15, wherein the first rotational shaft is positioned on the recessed portion of the first door and a main body of the first connection member is accommodated in the cutout region in the uppermost corner of the first door.

17. The refrigerator of claim 14, wherein the second door includes a recessed portion at the upper surface of the second door at a side of the second door that faces the first door when the second door is oriented in a closed position, and the recessed portion of the second door is a cutout region in an uppermost corner of the second door.

18. The refrigerator of claim 17, wherein the second rotational shaft is positioned on the recessed portion of the second door and a main body of the second connection member is accommodated in the cutout region in the uppermost corner of the second door.

19. The refrigerator of claim 14:

wherein the second door includes a recessed portion at the upper surface of the second door at a side of the second door that faces the first door when the second door is oriented in a closed position, and the recessed portion of the second door is a cutout region in an uppermost corner of the second door;

wherein the first door includes a recessed portion at the upper surface of the first door at a position adjacent to the recessed portion of the second door when the second door is oriented in a closed position, and the recessed portion of the first door is a cutout region in an uppermost corner of the first door;

wherein the first rotational shaft is positioned on the recessed portion of the first door and a main body of the first connection member is accommodated in the cutout region in the uppermost corner of the first door;

wherein the second rotational shaft is positioned on the recessed portion of the second door;

wherein the first connection member connects the first rotational shaft to the cabinet; and wherein the second connection member connects the second rotational shaft to the first door at the recessed portion of the first door and a main body of the second connection member is accommodated in the cutout region in the uppermost corner of the second door.

20. The refrigerator of claim 19, wherein the first rotational shaft, the second rotational shaft, the first connection member, and the second connection member are hidden by a front side of the second door when the second door is oriented in a closed position, the front side of the second door being a side of the second door that is furthest from the first door when the second door is oriented in a closed position.

* * * * *